US011052273B2

(12) United States Patent
Valenti et al.

(10) Patent No.: US 11,052,273 B2
(45) Date of Patent: Jul. 6, 2021

(54) ADJUSTABLE EXERCISE APPARATUS

(71) Applicants: Sean Paul Valenti, Springfield, IL (US); Justin Valenti, Springfield, IL (US)

(72) Inventors: Sean Paul Valenti, Springfield, IL (US); Justin Valenti, Springfield, IL (US)

( * ) Notice: Subject to any disclaimer, the term of this patent is extended or adjusted under 35 U.S.C. 154(b) by 0 days.

(21) Appl. No.: 16/546,102

(22) Filed: Aug. 20, 2019

(65) Prior Publication Data

US 2020/0054915 A1 Feb. 20, 2020

Related U.S. Application Data

(60) Provisional application No. 62/720,035, filed on Aug. 20, 2018.

(51) Int. Cl.

| | |
|---|---|
| ***A63B 21/00*** | (2006.01) |
| ***A63B 21/008*** | (2006.01) |
| ***A63B 23/12*** | (2006.01) |
| ***A63B 23/035*** | (2006.01) |

(52) U.S. Cl.

CPC .... *A63B 21/00069* (2013.01); *A63B 21/0083* (2013.01); *A63B 21/4035* (2015.10); *A63B 23/03541* (2013.01); *A63B 23/12* (2013.01)

(58) Field of Classification Search

CPC ..... A63B 21/0083; A63B 21/0087; A63B 21/0783; A63B 21/16; A63B 22/20–208

See application file for complete search history.

(56) References Cited

U.S. PATENT DOCUMENTS

| | | | | |
|---|---|---|---|---|
| 3,756,595 | A * | 9/1973 | Hague | A63B 22/0061 482/51 |
| 4,743,015 | A * | 5/1988 | Marshall | A63B 21/00072 482/112 |
| 4,750,739 | A * | 6/1988 | Lange | A63B 21/0083 482/104 |
| 4,768,775 | A * | 9/1988 | Marshall | A63B 22/0076 482/133 |
| 4,795,147 | A * | 1/1989 | Seal | A63B 22/0076 482/73 |
| 4,799,672 | A | 1/1989 | Barrett | |
| 4,982,952 | A * | 1/1991 | Wang | A63B 22/001 482/53 |

(Continued)

*Primary Examiner* — Jennifer Robertson

(57) ABSTRACT

An adjustable exercise apparatus is an apparatus that engages both halves of an antagonist muscle group during the extension and retraction of specific movements and exercises. The apparatus includes a base frame, a first track, a second track, a crossbar, a first resistance-piston system, a second resistance-piston system, a first lockable mount, and a second lockable mount. The base frame stabilizes the upright orientation of both the first track and the second track along the ground. The crossbar reinforces the position and the orientation of the first track and the second track with each other. The first resistance-piston system and the second resistance-piston system provides an adjustable resistance to a variety of movements and exercises throughout use. The first lockable mount and the second lockable mount secures the desired position of the first resistance-piston system and the second resistance-piston system along the first track and the second track, respectively.

9 Claims, 5 Drawing Sheets

(56) References Cited

U.S. PATENT DOCUMENTS

| | | | | |
|---|---|---|---|---|
| 5,000,441 | A * | 3/1991 | Wang | A63B 22/0002 482/112 |
| 5,108,093 | A * | 4/1992 | Watterson | A63B 22/0012 482/112 |
| 5,222,927 | A * | 6/1993 | Chang | A63B 21/0552 482/126 |
| 5,658,225 | A * | 8/1997 | Huang | A63B 22/0076 482/112 |
| 7,578,774 | B1 * | 8/2009 | Zetterberg | A63B 1/00 482/112 |
| 7,867,151 | B2 | 1/2011 | Hayes et al. | |
| 2013/0203566 | A1 * | 8/2013 | Finestein | A63B 23/1263 482/114 |
| 2016/0016033 | A1 * | 1/2016 | Schrag | A63B 21/4019 482/112 |
| 2016/0175638 | A1 * | 6/2016 | Pestes | A63B 21/4049 482/8 |

* cited by examiner

ADJUSTABLE EXERCISE APPARATUS

The current application claims priority to U.S. provisional application Ser. No. 62/720,035 filed on Aug. 20, 2018.

FIELD OF THE INVENTION

The present invention generally relates to exercise equipment. More specifically, the present invention is an adjustable exercise apparatus that applies resistance to pairs of antagonist muscles.

BACKGROUND OF THE INVENTION

In present times, individuals are known to employ standing exercise machines intended to provide variable resistance to user motion by straining particular muscle groups against said resistance. The field of strength training is known to include techniques emphasizing the importance of training muscle groups in antagonistic pairs, more specifically, training muscles opposite each other across planes defined across the body of a user. According to the antagonistic pair training techniques, these groups should ideally be trained in equal measure, simultaneously. This ensures that a user does not develop a musculature imbalance that may lead to injury or long-term conditions such as joint weakness or poor posture. The training of antagonist muscle sets may be facilitated via use of multiple devices that orient a resistive force at various angles to the user, such as a bench press for the chest and a rowing machine for the back. However, the antagonist pairs technique requires use of a larger variety of machines due the inherent directional limitations of said machines. Many machines known in the field are only capable of providing gauged resistance across one plane, in one direction. Even machines that are adjustable do not necessarily provide a wide enough range of resistive force to allow a user to exercise both halves of an antagonist pair without significantly rearranging said machine or switching to another apparatus entirely.

The present invention aims to allow a user to simultaneously train both halves of an antagonist muscle group utilizing a single machine, without necessitating the reconfiguration of said machine or adjustment of user posture. The present invention will be equipped with a means of adjusting the linear physical resistance of the resistive elements for both directions of stroke. Additionally, the present invention will enable the user to independently position the resistive elements at a variety of angles and relative positions to achieve any desired resistance profile. The variable resistance will ideally be accomplished by flexibly mounting a set of adjustable pneumatic devices to an overhead structure, each device individually equipped with a means of regulating the intake and exhaust of internal pressure. As the user manually operates the device, the remaining pressure, or vacuum, within will provide resistance to the operable component of said pneumatic device. It should be noted that the lack of persistent force, such as those exerted by conventional weights or resistance bands, may allow a user to disengage from the present invention at any point without risking damage to the present invention or injury to the user.

DETAILED DESCRIPTION OF THE INVENTION

All illustrations of the drawings are for the purpose of describing selected versions of the present invention and are not intended to limit the scope of the present invention.

Figure 3:
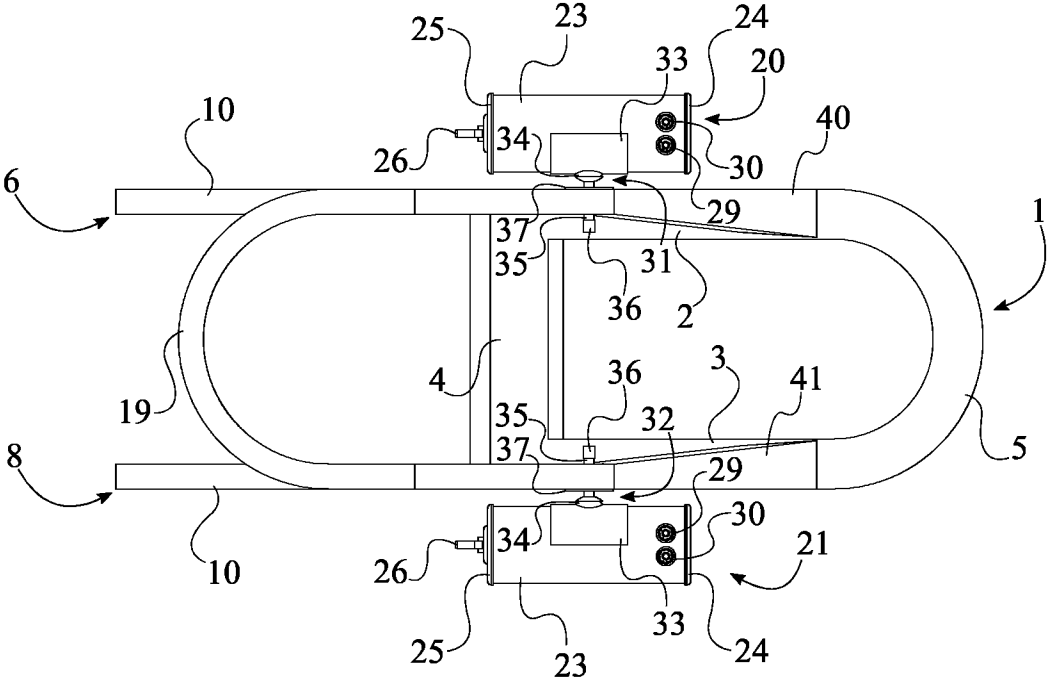
FIG. 3 is a top view of the present invention.

The present invention is an adjustable exercise apparatus for the training of antagonistic muscle pairs. The present invention applies controlled physical resistance to motions through pneumatic pressure vessels thereby enabling training antagonistic muscle pairs. More specifically, the present invention provides linear physical resistance and allows a user to independently move each arm. The angles of each motion may also be adjusted according to size of the user, the style of the exercise, and the comfortability of the user. In order to provide resistance to antagonistic muscles throughout a variety of exercises, the present invention comprises a base frame 1, a first track 6, a second track 8, a crossbar 19, a first resistance-piston system 20, a second resistance-piston system 21, a first lockable mount 31, and a second lockable mount 32, seen in FIG. 1, FIG. 3, and FIG. 4. The base frame 1 stabilizes the first track 6 and the second track 8 with each other. The first track 6 and the second track 8 allow the first resistance-piston system 20 and the second resistance-piston system 21, respectively, to be positioned and mounted according to exercise being performed with the present invention. The crossbar 19 offsets the first track 6 and the second track 8 from each other throughout use. The first resistance-piston system 20 and the second resistance-piston system 21 apply resistance to a variety of motions and exercises performed with the present invention. The first lockable mount 31 and the second lockable mount 32 secures the first resistance-piston system 20 and the second resistance-piston system 21 along the first track 6 and the second track 8, respectively.

The overall configuration of the aforementioned components allows the present invention to be accommodate a variety of users and exercises. In order for the first track 6 and the second track 8 to remain upright throughout use, the first track 6 and the second track 8 are fixed adjacent with the base frame 1, seen in FIG. 1. Moreover, a distal end 7 of the first track 6 and a distal end 9 of the second track 8 are oriented away from the base frame 1. The first track 6 and the second track 8 are positioned opposite each other across the base frame 1 so that the user may engage the first resistance-piston system 20 and the second resistance-piston system 21 simultaneously and independent of one another. The crossbar 19 is fixed in between the distal end 7 of the first track 6 and the distal end 9 of the second track 8, reinforcing the position of the first track 6 and the second track 8 with each other. A user may perform a variety of motions and exercises with the present invention as the first resistance-piston system 20 is slidably connected along the first track 6 with the first lockable mount 31. Similarly, the second resistance-piston system 21 is slidably connected along the second track 8 with the second lockable mount 32.

Figure 1:
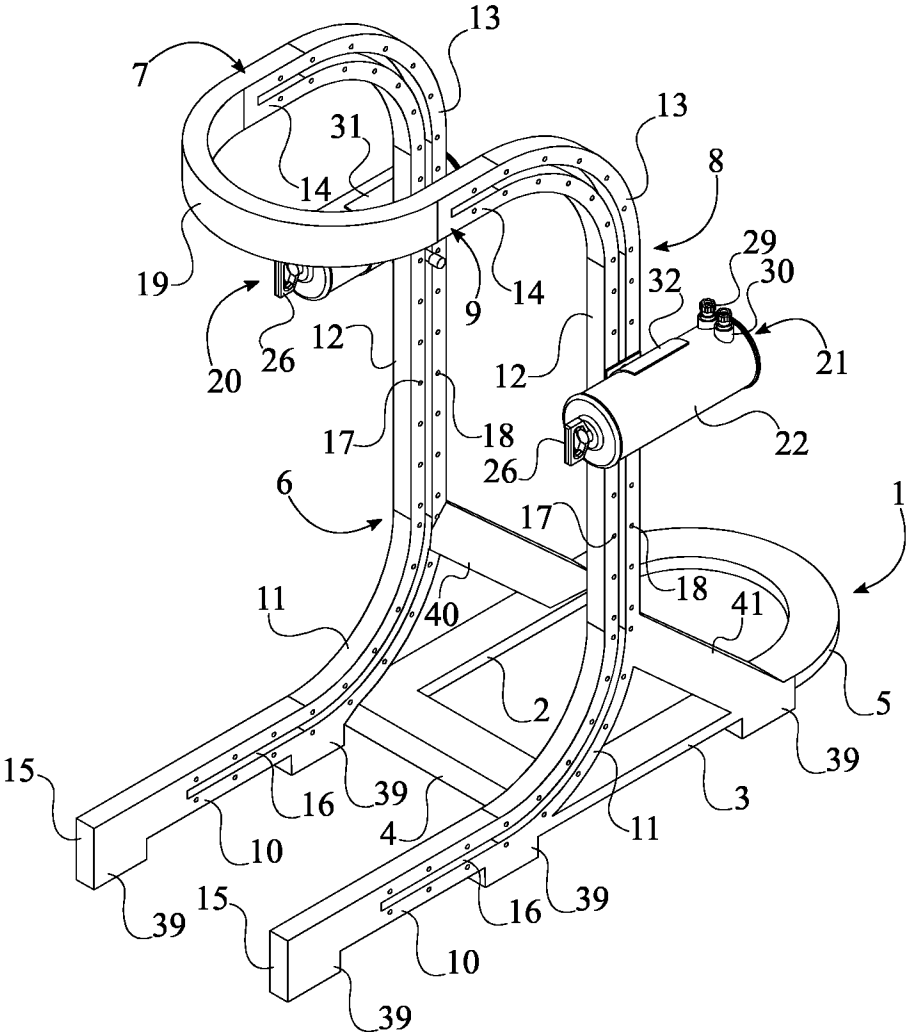
FIG. 1 is a perspective view of the present invention.
Figure 2:
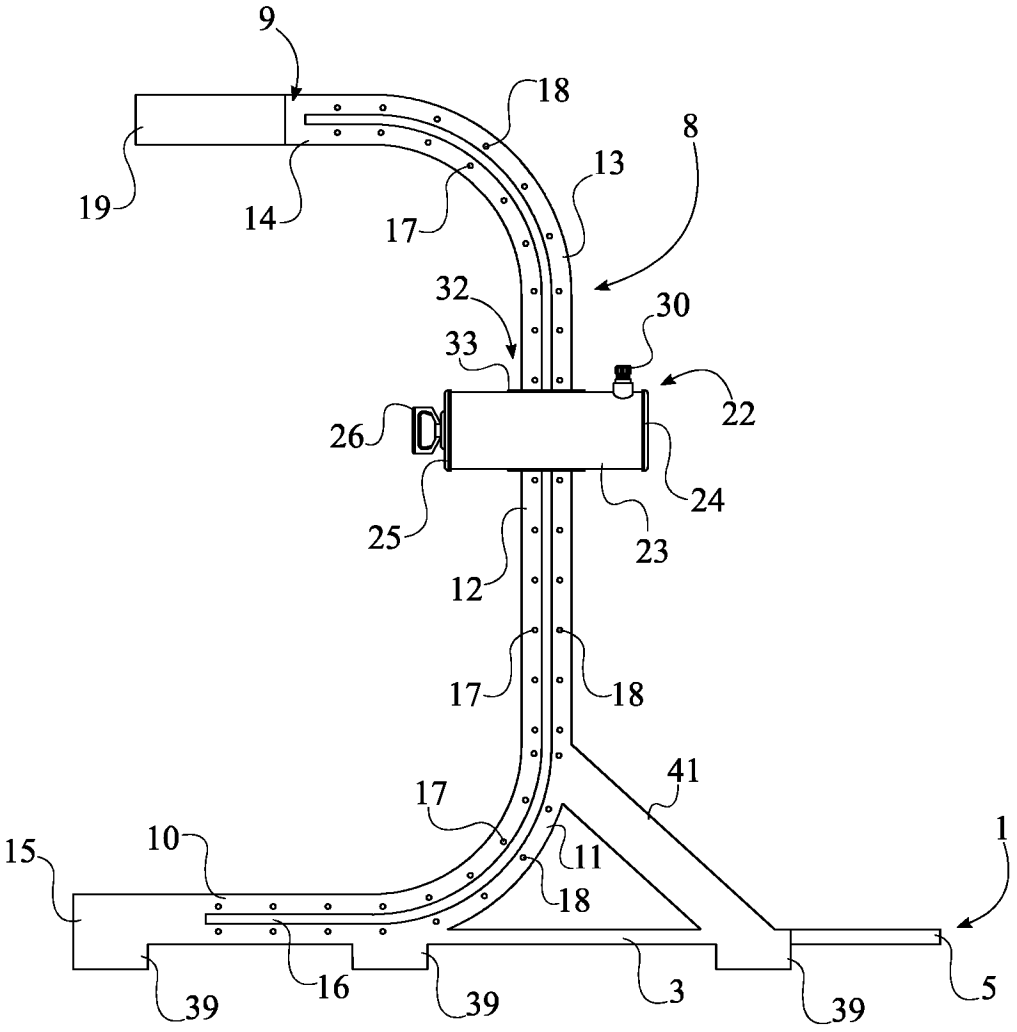
FIG. 2 is a side view of the present invention.
Figure 4:
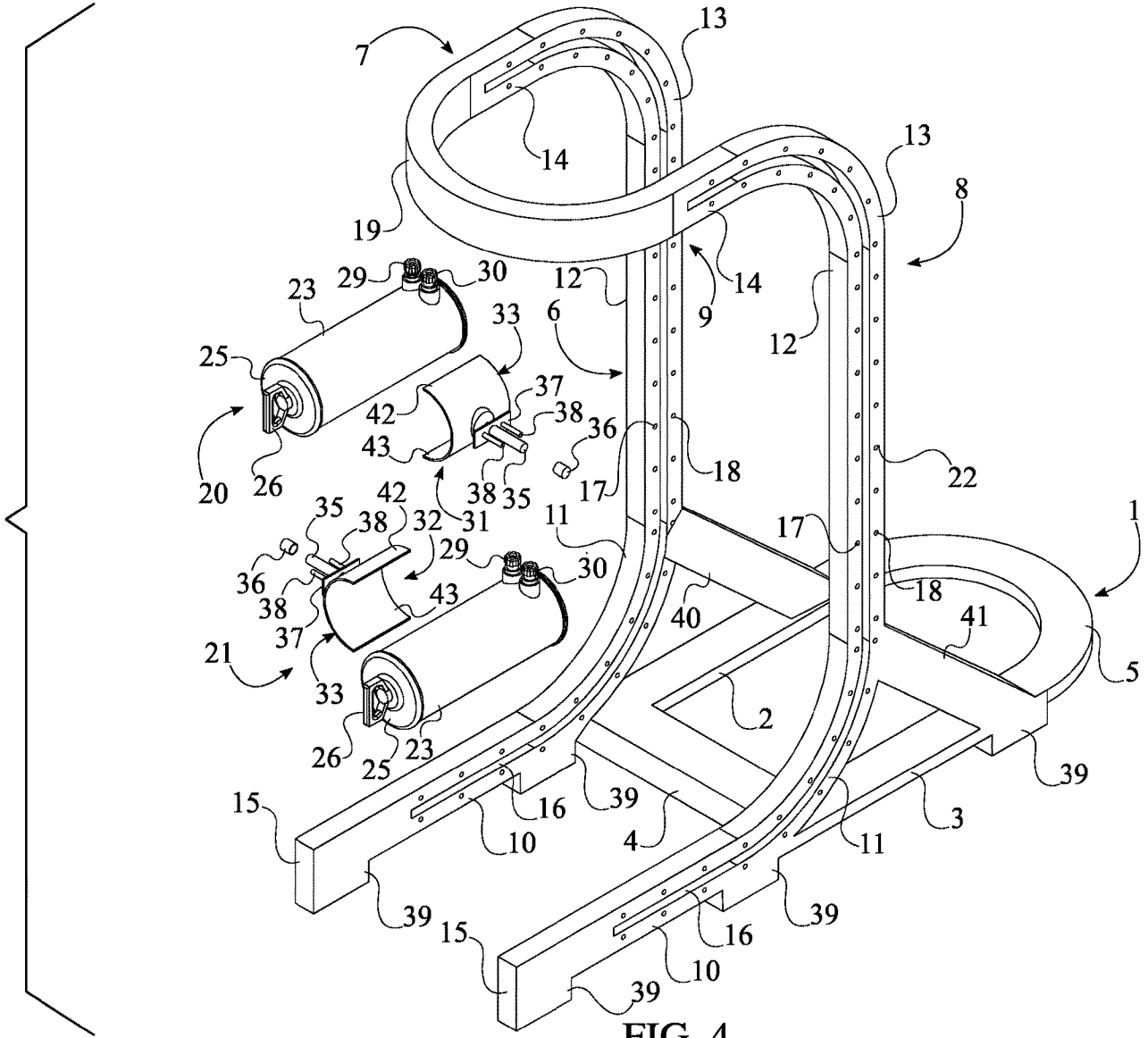
FIG. 4 is an exploded view of the present invention.
Figure 5:
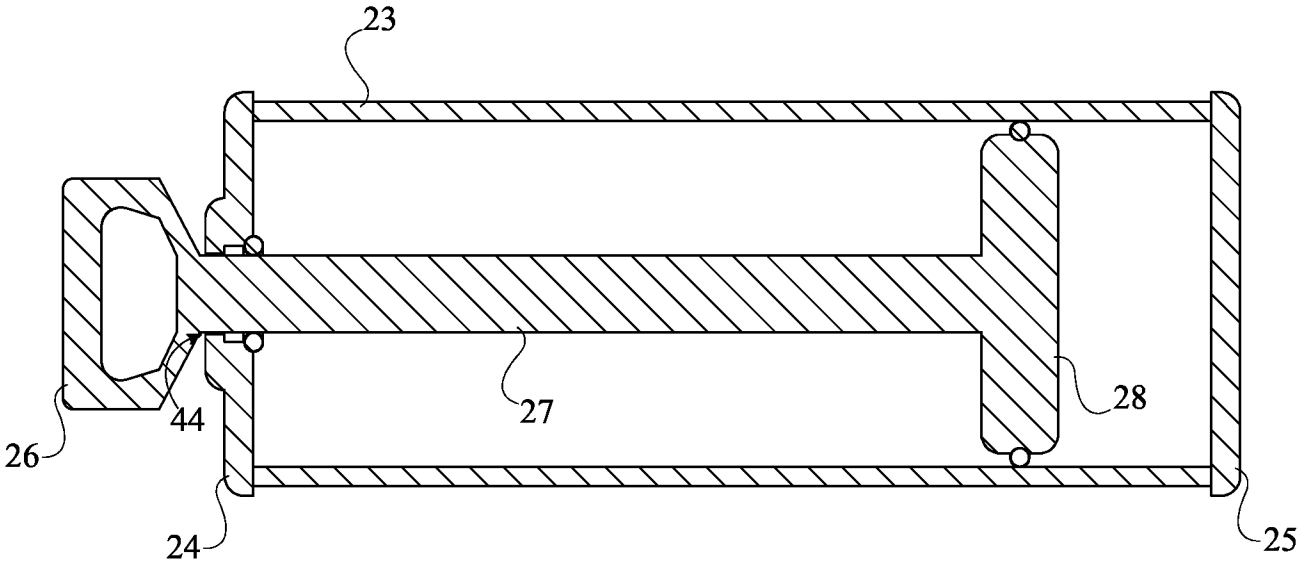
FIG. 5 is a schematic view of a handle, a rod, and a piston with a piston cylinder of the present invention.

In order to accommodate a variety of exercises, the first track 6 and the second track 8 each comprise a first linear member 10, a first curved member 11, a second linear member 12, a second curved member 13, and a third linear member 14, seen in FIG. 1, FIG. 2, and FIG. 4. The first linear member 10, the first curved member 11, the second linear member 12, the second curved member 13, and the third linear member 14 define a U-shape for the first track 6 and a U-shape for the second track 8 that maximizes the amount of exercises that are able to be performed with the present invention, seen in FIG. 2. The base frame 1 and the first curved member 11 are terminally positioned with the first linear member 10. The first curved member 11 is oriented away from the base frame 1 member and is fixed adjacent with the first linear member 10. This arrangement allows the base frame 1 to support and uphold the first track 6 and the second track 8 against the ground. The second linear member 12 is fixed adjacent with the first curved member 11, opposite to the first linear member 10. Moreover, the second linear member 12 is oriented perpendicular with the first linear member 10. The second curved member 13 is fixed adjacent the with the second linear member 12, opposite to the first linear member 10 and is oriented away from the base frame 1. The third linear member 14 is fixed adjacent with the second curved member 13, opposite to the second linear member 12. The third linear member 14 is oriented parallel with the first linear member 10, defining the U-shape for the first track 6 and a U-shape for the second track 8.

The first track 6, the second track 8, and the base frame 1 are further stabilized as the present invention further comprises a plurality of feet 39, seen in FIG. 1, FIG. 2, and FIG. 4. The plurality of feet 39 is distributed across the first linear member 10 of the first track 6, the base frame 1, and the first linear member 10 of the second track 8 as the first linear member 10 of the first track 6, the base frame 1, and the first linear member 10 of the second track 8 directly presses against the ground. Moreover, the plurality of feet 39 is positioned opposite to the first curved member 11 of the first track 6 and the first curved member 11 of the second track 8. The plurality of feet 39 is fixed with the first linear member 10 of the first track 6, the base frame 1, and the first linear member 10 of the second track 8, securely upholding the first track 6, the second track 8, and the base frame 1 above the ground.

In order for the first resistance-piston system 20 and the second resistance-piston system 21 to be positioned along the first track 6 and the second track 8, the first track 6 and the second track 8 each comprise an elongated body 15 and a slot 16, seen in FIG. 1, FIG. 2, and FIG. 4. Moreover, the first resistance-piston system 20 and the second resistance-piston system 21 each comprises a piston cylinder 22. The piston cylinder 22 is mountable with the first track 6 and the second track 8 as the first lockable mount 31 and the second lockable mount 32 each comprises a clamp 33, a ball-and-socket joint 34, a shaft 35, and a knob 36. The overall arrangement of these components allows the first resistance-piston system 20 and the second resistance-piston system 21 to be securely mounted with the first track 6 and the second track 8 throughout any motion or exercise. The slot 16 laterally traverses through the elongated body 15 and is positioned along the elongated body 15. The clamp 33 is terminally connected to the shaft 35 by the ball-and-socket joint 34 so that the piston cylinder 22 may be oriented at a variety of angles depending on the motion and the exercise. The ball-and-socket joint 34 is positioned adjacent with a convex surface 42 of the clamp 33, allowing the clamp 33 to grasp the piston cylinder 22. Moreover, the piston cylinder 22 of the first resistance-piston system 20 is mounted adjacent with a concave surface 43 of the clamp 33 of the first lockable mount 31. Similarly, the piston cylinder 22 of the second resistance-piston system 21 is mounted adjacent with a concave surface 43 of the clamp 33 of the second lockable mount 32. The first resistance-piston system 20 and the second resistance-piston system 21 may be positioned anywhere along the first track 6 and the second track 8 as the shaft 35 of the first lockable mount 31 is slidably engaged within the slot 16 of the first track 6. Similarly, the shaft 35 of the second lockable mount 32 is slidably engaged within the slot 16 of the second track 8. The knob 36 is positioned adjacent with the shaft 35, opposite to the ball-and-socket joint 34 and is threadedly coupled with the shaft 35. The knob 36 therefore fastens the desired position of the first resistance-piston system 20 and the second resistance-piston system 21 along the first track 6 and the second track 8, respectively.

The first resistance-piston system 20 only pivots about the ball-and-socket joint 34 as the first track 6 comprises a plurality of first holes 17 and a plurality of second holes 18, and the first lockable mount 31 comprises a base plate 37 and a pair of rods 38, seen in FIG. 4. The plurality of first holes 17 and the plurality of second holes 18 allows the pair of rods 38 to traverse through the elongated body 15 while preserving the structural integrity of the elongated body 15. The base plate 37 positions and orients the pair of rods 38. Moreover, the base plate 37 allows ball-and-socket joint 34 to press against the elongated body 15 while allowing the ball-and-socket joint 34 to pivot. The plurality of first holes 17 and the plurality of second holes 18 laterally traverse through the elongated body 15 of the first track 6 and are distributed along the slot 16 of the first track 6. Each of the plurality of first holes 17 is positioned opposite to a corresponding second holes of the plurality of second holes 18 across the slot 16 of the first track 6. The base plate 37 is positioned in between the ball-and-socket joint 34 and the shaft 35. Moreover, the ball-and-socket joint 34 is mounted onto the base plate 37. The shaft 35 of the first lockable mount 31 does not rotate as the pair of rods 38 is mounted onto the base plate 37, opposite to the ball-and-socket joint 34. The shaft 35 of the first lockable mount 31 is positioned the pair of rods 38 so that the shaft 35 traverses through the slot 16 and the pair of rods 38 traverse through a first hole of the plurality of first holes 17 and a corresponding second hole of the plurality of second holes 18, simultaneously. Furthermore, the pair of rods 38 is slidably engaged within a selected hole of the plurality of first holes 17 and a corresponding hole of the plurality of second holes 18 of the first track 6.

Similarly, the second resistance-piston system 21 also only pivots about the ball-and-socket joint 34 as the second track 8 comprises a plurality of first holes 17 and a plurality of second holes 18, and the second lockable mount 32 comprises a base plate 37 and a pair of rods 38, also seen in FIG. 4. The plurality of first holes 17 and the plurality of second holes 18 laterally traverse through the elongated body 15 of the second track 8 and are distributed along the slot 16 of the second track 8. Each of the plurality of first holes 17 is positioned opposite to a corresponding second holes of the plurality of second holes 18 across the slot 16 of the second track 8. The base plate 37 is positioned in between the ball-and-socket joint 34 and the shaft 35. Moreover, the ball-and-socket joint 34 is mounted onto the base plate 37. The shaft 35 of the second lockable mount 32 does not rotate as the pair of rods 38 is mounted onto the base plate 37, opposite to the ball-and-socket joint 34. The shaft 35 of the second lockable mount 32 is positioned in between the pair of rods 38 so that the shaft 35 traverses through the slot 16 and the pair of rods 38 traverse through a first hole of the plurality of first holes 17 and a corresponding second hole of the plurality of second holes 18, simultaneously. Furthermore, the pair of rods 38 is slidably engaged within a selected hole of the plurality of first holes 17 and a corresponding hole of the plurality of second holes 18 of the second track 8.

In order to adjust the resistance of the first resistance-piston system 20 and the second resistance-piston system 21, the first resistance-piston system 20 and the second resistance-piston system 21 each comprises a piston cylinder 22, a handle 26, a rod 27, a piston 28, a first flow-adjustable control valve 29, and a second flow-adjustable control valve 30, seen in FIG. 1, FIG. 2, FIG. 3, FIG. 4, and FIG. 5. Furthermore, the piston cylinder 22 comprises lateral wall 23, a base wall 24, and a cover plate 25. The piston cylinder 22 provides the resistance for a variety of motions and exercises. The handle 26 allows a user to grasp the first resistance-piston system 20 and apply the resistance to a motion or an exercise. The rod 27 connects the handle 26 to the piston 28, and the piston 28 allows resistance to be applied to both halves of an antagonist muscle group. The first flow-adjustable control valve 29 and the second flow-adjustable control valve 30 applies resistance with the extension and retraction of the handle 26. More specifically, the first flow-adjustable control valve 29 and the second flow-adjustable control valve 30 may also vary the intensity of resistance depending on the strength of the user. The overall arrangement of theses components allows resistance to be applied throughout extension and retraction of a motion or exercise. The base wall 24 is positioned adjacent with the lateral wall 23, and the cover plate 25 is positioned adjacent with the lateral wall 23, opposite to the base wall 24. The piston cylinder 22 is enclosed as the lateral wall 23 is perimetrically fixed with the base wall 24 and the cover plate 25. A user may adjust the intensity of resistance with the first resistance-piston system 20 and the second resistance-piston system 21 independently as the first flow-adjustable control valve 29 and the second flow-adjustable control valve 30 are externally mounted through the lateral wall 23, seen in FIG. 1, FIG. 2, FIG. 3, and FIG. 4. The first resistance-piston system 20 and the second resistance piston system 21 apply resistance during extension and retraction of an exercise as the rod 27 is slidably coupled through a central hole 44 of the cover plate 25. The resistance is applied to the motion and exercise performed while the user grasps onto the handle 26 as the handle 26 is terminally fixed with the rod 27 and is externally positioned with the piston cylinder 22, seen in FIG. 5. Moreover, the piston 28 is fixed adjacent with the rod 27, opposite to the handle 26 and is slidably engaged within the lateral wall 23. The resistance is consistently felt by the user throughout the entire exercise as the first flow-adjustable control valve 29 and the second flow-adjustable control valve 30 are operatively integrated into the piston cylinder 22, wherein the first flow-adjustable control valve 29 and the second flow-adjustable control valve 30 are each used to selectively adjust fluid flow into and out of the piston cylinder 22 in order to adjust a felt resistance while actuating the piston cylinder as a positive-displacement fluid pump. Therefore, both antagonist muscle pairs are constantly engaged throughout an exercise.

The structural integrity of both the first track 6 and the second track 8 is reinforced as the present invention further comprises a first counterfort 40 and a second counterfort 41. The first counterfort 40 is mounted in between the first track 6 and the base frame 1. Similarly, the second counterfort 41 is mounted in between the second track 8 and the base frame 1, seen in FIG. 1 and FIG. 4. In order for the base frame 1 to support and stabilize the first track 6 and the second track 8, the base frame 1 comprises a first arm 2, a second arm 3, a first stabilizing bar 4, and a second stabilizing bar 5. The first arm 2 is fixed adjacent with the first track 6. Similarly, the second arm 3 is fixed adjacent the second track 8. The first stabilizing bar 4 and the second stabilizing bar 5 are fixed in between the first arm 2 and the second arm 3. More specifically, the first stabilizing arm is positioned adjacent with the first track 6 and the second track 8. The second stabilizing bar 5 is positioned offset from the first stabilizing bar 4, opposite the first track 6 and the second track 8.

Although the invention has been explained in relation to its preferred embodiment, it is to be understood that many other possible modifications and variations can be made without departing from the spirit and scope of the invention as hereinafter claimed.

What is claimed is:

1. An adjustable exercise apparatus for the training of antagonistic muscle pairs comprises:

a base frame;
a first track;
a second track;
a crossbar;
a first resistance-piston system;
a second resistance-piston system;
a first lockable mount;
a second lockable mount;
the first track and the second track being fixed adjacent with the base frame;
a distal end of the first track and a distal end the second track being oriented away from the base frame;
the first track and the second track being positioned opposite to each other across the base frame;
the crossbar being fixed in between the distal end of the first track and the distal end of the second track;
the first resistance-piston system being slidably connected along the first track with the first lockable mount;
the second resistance-piston system being slidably connected along the second track with the second lockable mount;
the first track and the second track each comprise an elongated body and a slot;
the first resistance-piston system and the second resistance-piston system each comprises a piston cylinder;
the first lockable mount and the second lockable mount each comprises a clamp, a ball-and-socket joint, a shaft, and a knob;
the slot of the first track laterally traversing through the elongated body of the first track;
the slot of the first track being positioned along the elongated body of the first track;
the clamp of the first lockable mount being terminally connected to the shaft of the first lockable mount by the ball-and-socket joint of the first lockable mount;
the ball-and-socket joint of the first lockable mount being positioned adjacent with a convex surface of the clamp of the first lockable mount;
the piston cylinder of the first resistance-piston system being mounted adjacent with a concave surface of the clamp of the first lockable mount;
the shaft of the first lockable mount being slidably engaged within the slot of the first track;
the knob of the first lockable mount being positioned adjacent with the shaft of the first lockable mount, opposite to the ball-and-socket joint of the first lockable mount;
the knob of the first lockable mount being threadedly coupled with the shaft of the first lockable mount;
the slot of the second track laterally traversing through the elongated body of the second track;

the slot of the second track being positioned along the elongated body of the second track;

the clamp of the second lockable mount being terminally connected to the shaft of the second lockable mount by the ball-and-socket joint of the second lockable mount;

the ball-and-socket joint of the second lockable mount being positioned adjacent with a convex surface of the clamp of the second lockable mount;

the piston cylinder of the second resistance-piston system being mounted adjacent with a concave surface of the clamp of the second lockable mount;

the shaft of the second lockable mount being slidably engaged within the slot of the second track;

the knob of the second lockable mount being positioned adjacent with the shaft of the second lockable mount, opposite to the ball-and-socket joint of the second lockable mount; and the knob of the second lockable mount being threadedly coupled with the shaft of the second lockable mount.

2. The adjustable exercise apparatus for the training of antagonistic muscle pairs as claimed in claim 1 comprises:

the first track and the second track each comprise a first linear member, a first curved member, a second linear member, a second curved member, and a third linear member;

the base frame and the first curved member of the first track being terminally positioned with the first linear member of the first track;

the first curved member of the first track being oriented away from the base frame;

the first curved member of the first track being fixed adjacent with the first linear member of the first track;

the second linear member of the first track being fixed adjacent with the first curved member of the first track, opposite to the first linear member of the first track;

the second linear member of the first track being oriented perpendicular with the first linear member of the first track;

the second curved member of the first track being fixed adjacent with the second linear member of the first track, opposite to the first linear member of the first track;

the second curved member of the first track being oriented away from the base frame;

the third linear member of the first track being fixed adjacent with the second curved member of the first track, opposite to the second linear member of the first track;

the third linear member of the first track being oriented parallel with the first linear member of the first track;

the base frame and the first curved member of the second track being terminally positioned with the first linear member of the second track;

the first curved member of the second track being oriented away from the base frame;

the first curved member of the second track being fixed adjacent with the first linear member of the second track;

the second linear member of the second track being fixed adjacent with the first curved member of the second track, opposite to the first linear member of the second track;

the second linear member of the second track being oriented perpendicular with the first linear member of the second track;

the second curved member of the second track being fixed adjacent with the second linear member of the second track, opposite to the first linear member of the second track;

the second curved member of the second track being oriented away from the base frame;

the third linear member of the second track being fixed adjacent with the second curved member of the second track, opposite to the second linear member of the second track; and the third linear member of the second track being oriented parallel with the first linear member of the second track.

3. The adjustable exercise apparatus for the training of antagonistic muscle pairs as claimed in claim 2 comprises:

a plurality of feet;

the plurality of feet being distributed across the first linear member of the first track, the base frame, and the first linear member of the second track;

the plurality of feet being positioned opposite to the first curved member of the first track and the first curved member of the second track; and, the plurality of feet being fixed with the first linear member of the first track, the base frame, and the first linear member of the second track.

4. The adjustable exercise apparatus for the training of antagonistic muscle pairs as claimed in claim 1 comprises:

the first track further comprises a plurality of first holes and a plurality of second holes;

the first lockable mount comprises a base plate and a pair of rods;

the plurality of first holes and the plurality of second holes laterally traversing through the elongated body of the first track;

the plurality of first holes and the plurality of second holes being distributed along the slot of the first track;

each of the plurality of first holes being positioned opposite to a corresponding second hole of the plurality of second holes across the slot of the first track;

the base plate being positioned between the ball-and-socket joint of the first lockable mount and the shaft of the first lockable mount;

the ball-and-socket joint of the first lockable mount being mounted onto the base plate;

the pair of rods being mounted onto the base plate, opposite to the ball-and-socket joint of the first lockable mount;

the shaft of the first lockable mount being positioned in between the pair of rods; and the pair of rods being slidably engaged within a selected hole of the plurality of first holes and a corresponding second hole of the plurality of second holes of the first track.

5. The adjustable exercise apparatus for the training of antagonistic muscle pairs as claimed in claim 1 comprises:

the second track comprises a plurality of first holes and a plurality of second holes;

the second lockable mount comprises a base plate and a pair of rods;

the plurality of first holes and the plurality of second holes laterally traversing through the elongated body of the second track;

the plurality of first holes and the plurality of second holes being distributed along the slot of the second track;

each of the plurality of first holes being positioned opposite to a corresponding second hole of the plurality of second holes across the slot of the second track;

the base plate being positioned between the ball-and-socket joint of the second lockable mount and the shaft of the second lockable mount;

the ball-and-socket joint of the second lockable mount being mounted onto the base plate;

the pair of rods being mounted onto the base plate, opposite to the ball-and-socket joint;

the shaft of the second lockable mount being positioned in between the pair of rods; and, the pair of rods being slidably engaged within a selected hole of the plurality of first holes and a corresponding second hole of the plurality of second holes of the second track.

6. The adjustable exercise apparatus for the training of antagonistic muscle pairs as claimed in claim 1 comprises:

the first resistance-piston system and the second resistance-piston system each comprises a piston cylinder, a handle, a rod, a piston, a first flow-adjustable control valve, and a second flow-adjustable control valve;

the piston cylinder of the first resistance-piston system comprises a lateral wall, a base wall, and a cover plate;

the base wall of the piston cylinder of the first resistance-piston system being positioned adjacent with the lateral wall of the piston cylinder of the first resistance-piston system;

the cover plate of the piston cylinder of the first resistance-piston system being positioned adjacent with the lateral wall of the piston cylinder of the first resistance-piston system, opposite to the base wall of the piston cylinder of the first resistance-piston system;

the lateral wall of the piston cylinder of the first resistance-piston system being perimetrically fixed with the base wall of the piston cylinder of the first resistance-piston system and the cover plate of the piston cylinder of the first resistance-piston system;

the first flow-adjustable control valve of the first resistance-piston system and the second flow-adjustable control valve of the first resistance-piston system being externally mounted through the lateral wall of the piston cylinder of the first resistance-piston system;

the rod of the first resistance-piston system being slidably coupled through a central hole of the cover plate of the piston cylinder of the first resistance-piston system;

the handle of the first resistance-piston system being terminally fixed with the rod of the first resistance-piston system;

the handle of the first resistance-piston system being externally positioned with the piston cylinder of the first resistance-piston system;

the piston of the first resistance-piston system being fixed adjacent with the rod of the first resistance-piston system, opposite to the handle of the first resistance-piston system;

the piston of the first resistance-piston system being slidably engaged within the lateral wall of the piston cylinder of the first resistance-piston system;

the first flow-adjustable control valve of the first resistance-piston system and the second flow-adjustable control valve of the first resistance-piston system being operatively integrated into the piston cylinder of the first resistance-piston system, wherein the first flow-adjustable control valve of the first resistance-piston system and the second flow-adjustable control valve of the first resistance-piston system are each used to selectively adjust fluid flow into and out of the piston cylinder of the first resistance-piston system in order to adjust a felt resistance while actuating the piston cylinder of the first resistance-piston system as a positive-displacement fluid pump;

the piston cylinder of the second resistance-piston system comprises a lateral wall, a base wall, and a cover plate;

the base wall of the piston cylinder of the second resistance-piston system being positioned adjacent with the lateral wall of the piston cylinder of the second resistance-piston system;

the cover plate of the piston cylinder of the second resistance-piston system being positioned adjacent with the lateral wall of the piston cylinder of the second resistance-piston system, opposite to the base wall of the piston cylinder of the second resistance-piston system;

the lateral wall of the piston cylinder of the second resistance-piston system being perimetrically fixed with the base wall of the piston cylinder of the second resistance-piston system and the cover plate of the piston cylinder of the second resistance-piston system;

the first flow-adjustable control valve of the second resistance-piston system and the second flow-adjustable control valve of the second resistance-piston system being externally mounted through the lateral wall of the piston cylinder of the second resistance-piston system;

the rod of the second resistance-piston system being slidably coupled through a central hole of the cover plate of the piston cylinder of the second resistance-piston system;

the handle of the second resistance-piston system being terminally fixed with the rod of the second resistance-piston system;

the handle of the second resistance-piston system being externally positioned with the piston cylinder of the second resistance-piston system;

the piston of the second resistance-piston system being fixed adjacent with the rod of the second resistance-piston system, opposite to the handle of the second resistance-piston system;

the piston of the second resistance-piston system being slidably engaged within the lateral wall of the piston cylinder of the second resistance-piston system; and the first flow-adjustable control valve of the second resistance-piston system and the second flow-adjustable control valve of the second resistance-piston system being operatively integrated into the piston cylinder of the second resistance-piston system, wherein the first flow-adjustable control valve of the second resistance-piston system and the second flow-adjustable control valve of the second resistance-piston system are each used to selectively adjust fluid flow into and out of the piston cylinder of the second resistance-piston system in order to adjust a felt resistance while actuating the piston cylinder of the second resistance-piston system as a positive-displacement fluid pump.

7. The adjustable exercise apparatus for the training of antagonistic muscle pairs as claimed in claim 1 comprises:

a first counterfort; and, the first counterfort being mounted in between the first track and the base frame.

8. The adjustable exercise apparatus for the training of antagonistic muscle pairs as claimed in claim 1 comprises:

a second counterfort; and, the second counterfort being mounted in between the second track and the base frame.

9. The adjustable exercise apparatus for the training of antagonistic muscle pairs as claimed in claim 1 comprises:

the base frame comprises a first arm, a second arm, a first stabilizing bar, and a second stabilizing bar;

the first arm being fixed adjacent with the first track;

the second arm being fixed adjacent with the second track;

the first stabilizing bar and the second stabilizing bar being fixed between the first arm and the second arm;

the first stabilizing bar being positioned adjacent with the first track and the second track; and, the second stabilizing bar being positioned offset from the first stabilizing bar, opposite the first track and the second track.

* * * * *